US006250117B1

(12) United States Patent
Wunner

(10) Patent No.: US 6,250,117 B1
(45) Date of Patent: Jun. 26, 2001

(54) WARP KNITTED FABRIC AND A METHOD FOR PRODUCING A WARP KNITTED FABRIC

(75) Inventor: Roland Wunner, Schwarzenbach (DE)

(73) Assignee: Liba Maschinenfabrik GmbH (DE)

( * ) Notice: Subject to any disclaimer, the term of this patent is extended or adjusted under 35 U.S.C. 154(b) by 0 days.

(21) Appl. No.: 09/493,014

(22) Filed: Jan. 28, 2000

(30) Foreign Application Priority Data

Nov. 26, 1999 (DE) ..... 199 57 019

(51) Int. Cl.[7] ..... D04B 21/06
(52) U.S. Cl. ..... 66/195; 442/312
(58) Field of Search ..... 66/190, 191, 192, 66/193, 195; 442/305, 312, 313, 314

(56) References Cited

U.S. PATENT DOCUMENTS 3,762,186 * 10/1973 Kohl ..... 66/192
4,044,576 * 8/1977 Kurz ..... 66/192
4,074,543 * 2/1978 Schmidt ..... 66/192
4,215,684 * 8/1980 Westip ..... 66/192
5,074,129 * 12/1991 Matthew ..... 66/192
5,619,869 * 4/1997 Tacy ..... 66/192

FOREIGN PATENT DOCUMENTS 198 16 440 C1 7/1999 (DE) .

* cited by examiner

*Primary Examiner*—Danny Worrell
(74) *Attorney, Agent, or Firm*—Banner & Witcoff, Ltd.

(57) ABSTRACT

A warp knitted fabric is disclosed having large grid openings formed by biaxially arranged stay- and weft threads. Also disclosed is a method of making the fabric. The method involves providing stay threads and weft threads which are bound to each other by stitches provided by warp threads. The number of stitches per unit length within a repeat and in the spacing between the crossing areas of the stay- and the weft threads is at least partially smaller than within the crossing areas themselves.

10 Claims, 6 Drawing Sheets

WARP KNITTED FABRIC AND A METHOD FOR PRODUCING A WARP KNITTED FABRIC

BACKGROUND OF THE INVENTION

The invention pertains to a warp knitted fabric having large grid openings, especially a Geo-grid, and a method for the production of such a warp knitted fabric which exhibits a biaxial, specifically a textile structure, having stay- and weft threads being arranged in groups in a crossing array.

Such knitted structures having large grid-like openings are applicable, especially as Geo-grid fabrics, in different regional as well as civil areas. For example, in the highway construction as a reinforcement for asphalt, as a reinforcement in the banks of canals or as a reinforcement for an embankment in man-made slopes.

Warp knitted fabrics with large grid openings, simply called Geo-grid fabrics hereafter, are also used as an intermediate product in the production of, for example, reinforced planar foiles, in plaster and cement reinforcements or as a carrier in layered products, all because of its specific characteristics that is, low weight, low cost and good permeability.

Heretofore Geo-grids, produced under currently known methods, consist of stay- and weft threads being combined crosswise in groups relative to each other which are firmly connected to or knitted with each other by so-called warp threads which form stitches. The continuously formed stitches around the stay threads serve as an additional stabilizing factor at the crossing points of the stay- and the weft threads as well as in the spacing between the crossing points of the Geo-grid material. However it has been shown, as a disadvantage. that the speed of the production of such a Geo-grid fabric cannot be raised, during a short term duration of the RPM of the machine and the concomitant high frequency of stitch forming because it is technically not feasible .

DE 198 16 440 C1 describes a method for the production of a warp knitted fabric in which arbitrary pattern variations with differing pattern repeats can be produced by lateral conveyors which vary in their speeds. In this arrangement, the lateral conveyor is driven independently from the drive of the knitting machine. This method is unsuitable in the efficient production of a Geo-grid fabric having an unchanged grid pattern because the production speed finally cannot be increased. One can merely obtain variable grid spacings by way of the differing speeds of the lateral conveyors but not, however, by variable pull-off speeds of the knitted fabric.

OBJECTS OF THE INVENTION

It is an object of the present invention to provide an increase in the production of a knitted fabric having large grid openings therein, and yet exhibiting a high grade quality, and a method that provides an effective and simple way of producing such a knitted fabric.

This object is achieved by way of the warp knitted fabric having the characteristics of claim 1 as well as a method for the production of such a knitted fabric including the steps as recited in claim 6.

Appropriate further developments and embodiments have been recited in respective dependent claims.

The warp knitted fabric according to claim 1 consists of biaxially arranged stayand weft threads having large spacings and further consists of warp threads forming stitches which bind the stay threads therein. In the crossing areas of the stay and the weft threads, the weft threads and the stay threads are knitted together by the warp threads, whereby the number of the stitches per unit length (stitch density) within a repeat and in the section of the crossing areas of the stay and the weft threads is at least partially smaller than the crossing areas per se.

Thereby on one hand, the necessary supply of warp threads in the knitted fabric is less according to the invention when compared to the state of the art. The stay- and weft threads, at their crossing points where a firm connection is mandated, are merely knitted together by the warp threads including a high number of stitches. In the spacing between the crossing areas, however, where properly no connections need to be made, the knitted fabric has a low stitch density and thereby a lower number of stitches. That means that within a repeat, the knitted fabric exhibits differing stitch densities. That is, in those sections where a connecting function of the stitches is important, there is the presence of a high stitch density and in those sections where the stitches merely serve as a reinforcement, that is, a sideways connection with the stay threads, the fabric exhibits a lower stitch density.

On the other hand, the total number of stitches in the knitted fabric, according to the invention is less than in heretofore known knitted fabrics. Therefore, the knitted fabric can be produced at a higher speed than until now, because the time consuming stitch formation has been reduced. In this manner, a high quality Geo-grid fabric can be produced which has a high tensile strength, a firm cohesion of the stay- and the weft threads in their crossing areas, and has a high slide resistance and a possible low elongation and furthermore can be produced in a cost effective manner and a high productivity.

In an advantageous embodiment of the invention, each of the stay threads is bound in individually, that is, stay threads that are adjacent to each other are bound in individually. This has the advantage that the stay- and the weft threads that are arranged biaxially, respectively, are knitted separately by way of stitches. This is especially advantageous when the Geo-grid is to be used as a composite material or as a carrier in layering. An example is in the casting of the knitted fabric in an epoxy resin.

In a further advantageous embodiment of the invention, there are at least two adjacently lying stay threads connected to each other. In this manner, the knitted material, that is, the Geo-grid is especially useful in a further development because the biaxially crosswise structure has form stability and is formed evenly over the whole structure of the Geo-grid, that is, it is formed as an even and unitary knitted unit.

According to a further advantageous embodiment of the invention, a special fleece is provided below the weft threads and/or between the weft- and the stay threads. Thereby, the knitted material is especially suitable as a planar compound material in areas where a partial permeability or an impermeability is mandated. For example, this could be the case in bank emplacements or in the construction of street beds. The cover layer, that is, the fleece preferably consists of a coarse material having good adhesion characteristics.

According to the inventive method for the production of a biaxial structure of a warp knitted fabric having large openings. stay- and weft threads are arranged crosswise and in groups and are thereafter knitted together by way of warp threads forming stitches. Thereby, the number of stitches within a repeat of the structure is reduced in the spacing between the crossing areas of the stay- and weft threads when compared to the number of stitches within the crossing areas. The structure is pulled off, according to the repeat, at a slower rate in the crossing areas than between adjacent crossing areas. Because of the differing pull-off speeds of the knitted fabric, the stitch density can be varied in a simple manner without a change in the RPM of the machine, meaning the actual speed of knitting. The speed of the pull-off can be varied within small intervals, that is, several times within a repeat of the pattern. The decrease in the stitch density results in that altogether less stitches have to be formed in the production of the knitted fabric whereby the productivity of the inventive method is considerably increased. Furthermore, the needed amount of the warp thread supply is less when compared to the state of the art of the technology using unchanged stitch densities. This also is results in savings in cost and thereby to an increase in the productivity.

According to a further development of the inventive method, a special fleece runs in below the weft threads having a speed which is essentially the same as the stay threads being guided in. Thereby, a composite material having large openings, as in a Geo-grid, and having a fleece, whereby the large openings are closed by the incoming fleece. Because of the harmonization of the speeds, a compound structure is produced having an evenly bound-in cover layer resulting in a low cost and a high productivity. For certain applications, it is essential that the large openings of the biaxial structure are partially or totally impervious.

In connection with the above aspect of the invention, the cover layer moves between the stay- and the weft threads with such a speed which is essentially the same as the guiding-in speed of the stay threads. In this manner, the cover layer is held in place by threads on both sides of the biaxial structure the Geo-grid. This improves the connection of the cover layer with the Geo-grid (and a separation of the fleece is prevented) on one hand and on the other hand leads to advantageous characteristics in the application of the Geo-grid because the knitted fabric can be subjected to on both sides by materials and/or fluids.

According to a further development of the method of the invention, the stitch density is varied by maintaining a constant RPM of the machine. This has the advantage in that the high speeds driving the knitting machines do not have to be changed during the execution of the method of the invention. Any change in the RPM of the machine can result in flaws in the forming of stitches. By maintaining the RPM of the machine, the frequency of the stitch forming remains constant. The stitch density is merely changed by varying the speed of the pull-off of the fabric without influencing the respective knitting process of the method of the production.

According to a further advantageous embodiment of the invention, the weft threads are inserted by a weft insertion system whereby the threads are guided into the area of the knitting needles by way of lateral conveyors which are driven independently from the drive of the warp knitting machine that produces the warp knitted fabric. The lateral conveyors are controlled with a speed that is at least partially intermittent and/or continuous and is at least a partially varying so that the waft threads are guided into the areas of the knitting needles at arbitrary points in time and successively in arbitrarily desired numbers all according to a pattern. In this manner, according to the method, the spacings between the weft threads and the groups of weft threads can be varied so that not only the stitch density but also the size of the openings (in longitudinal direction) can be changed in the Geo-grid being produced.

Further advantages, characteristics and possible applications of the invention will now be explained in detail by way of examples of embodiments and by making reference to the drawings.

DETAILED DESCRIPTION OF THE INVENTION

Figure 1A:
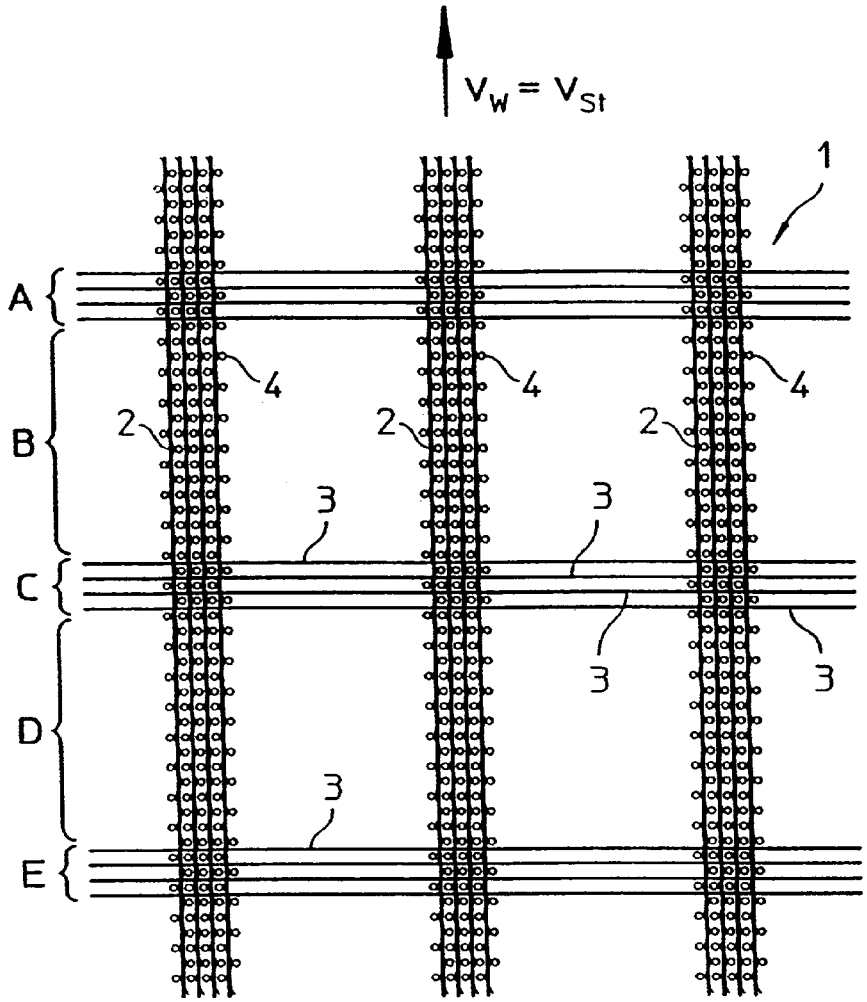
Fig. 1a PRIOR ART
FIG. 1*a* is a simplified illustration of a knitted fabric having an unchanged stitch density and having been produced by the state of the art technology.
Figure 1B:
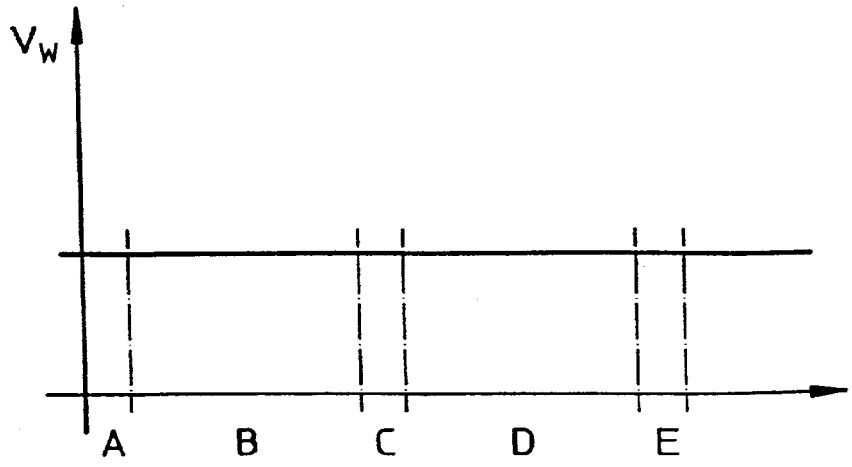
Fig. 1b PRIOR ART
FIG. 1*b* illustrates the pull-off speed of the fabric sector during the production of the knitted fabric of FIG. 1*a;*

FIG. 1*a* illustrates a knitted fabric having large openings according to the state of the art and FIG. 1*b* shows the production of a knitted fabric having employed the fabric pull-off speed in dependence from the fabric sector. The Geo-grid 1 mostly consists of stay threads 2 combined into groups and crossing weft threads 3, wherein, between the groups, a relatively large spacing has been provided for the formation of large grid openings. The stay threads 2 are continuously bound-in in the direction of the fabric pull-off (arrow in FIG. 1*a*) by stitch forming warp threads to connect the stay threads 2 and the weft threads 3 in their crossing area. The associated diagram in FIG. 1*b* shows that the speed of the fabric pull-off Vw is constant over the fabric sector during the production of the Geo-grid as shown in FIG. 1*a*. The letters A–E in FIGS. 1*a* and 1*b* indicate areas having weft threads being combined and areas without weft threads 3.

Figure 2A:
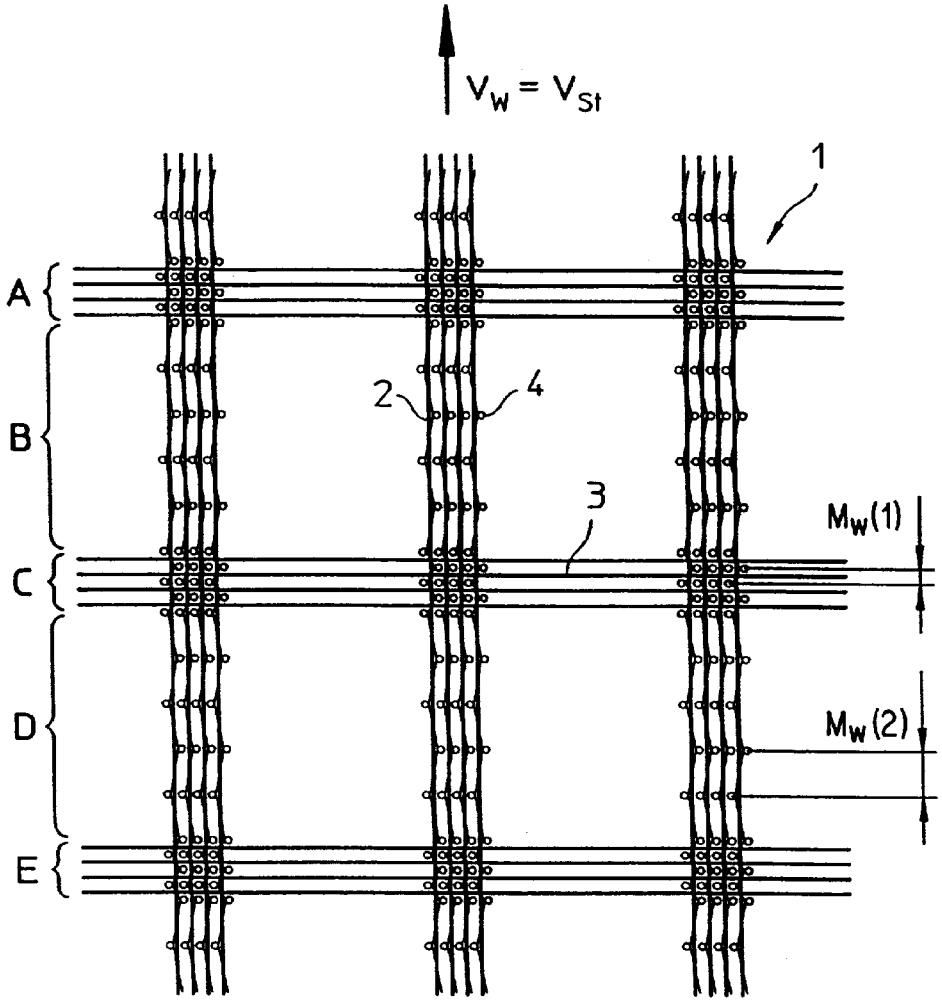
FIG. 2*a* is a simplified illustration of a knitted fabric having two differing stitch densities within one repeat.

FIG. 2*a* shows a Geo-grid according to the invention wherein the stitch density between the crossing areas of stay threads 2 and weft threads is smaller than the stitch density within the crossing areas. Analogous to the stitch density are also the spacings between the individual stitches designated with Mw(1) and Mw(2) within a repeat. The formed stitches being formed by the continuous warp threads 4 can, for example. be formed as a tricot binding or a double tricot binding. As can be seen in the diagram in FIG. 2*b*, the differing stitch densities of the knitted fabric over a given fabric section, is caused by the variation of the fabric pull-off speed Vw.

Figure 2B:
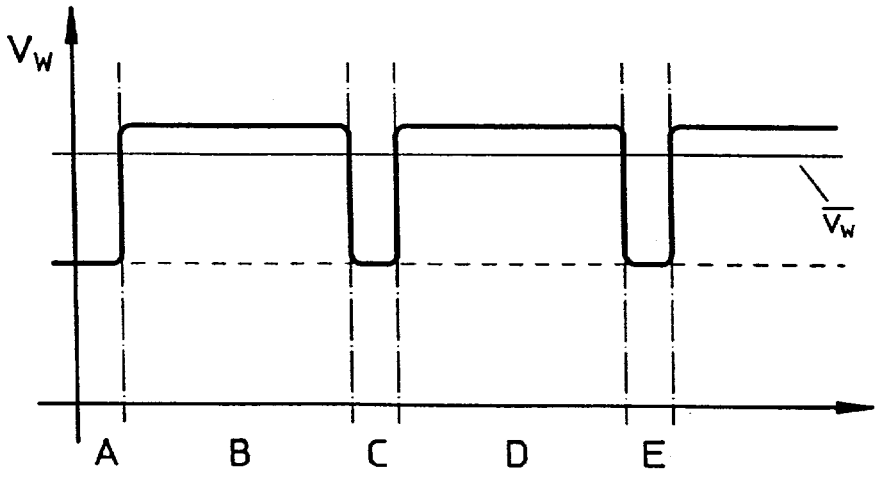
FIG. 2*b* illustrates the fabric pull-off speed of the fabric section during the production of the knitted fabric shown in FIG. 2*a;*
Figure 3A:
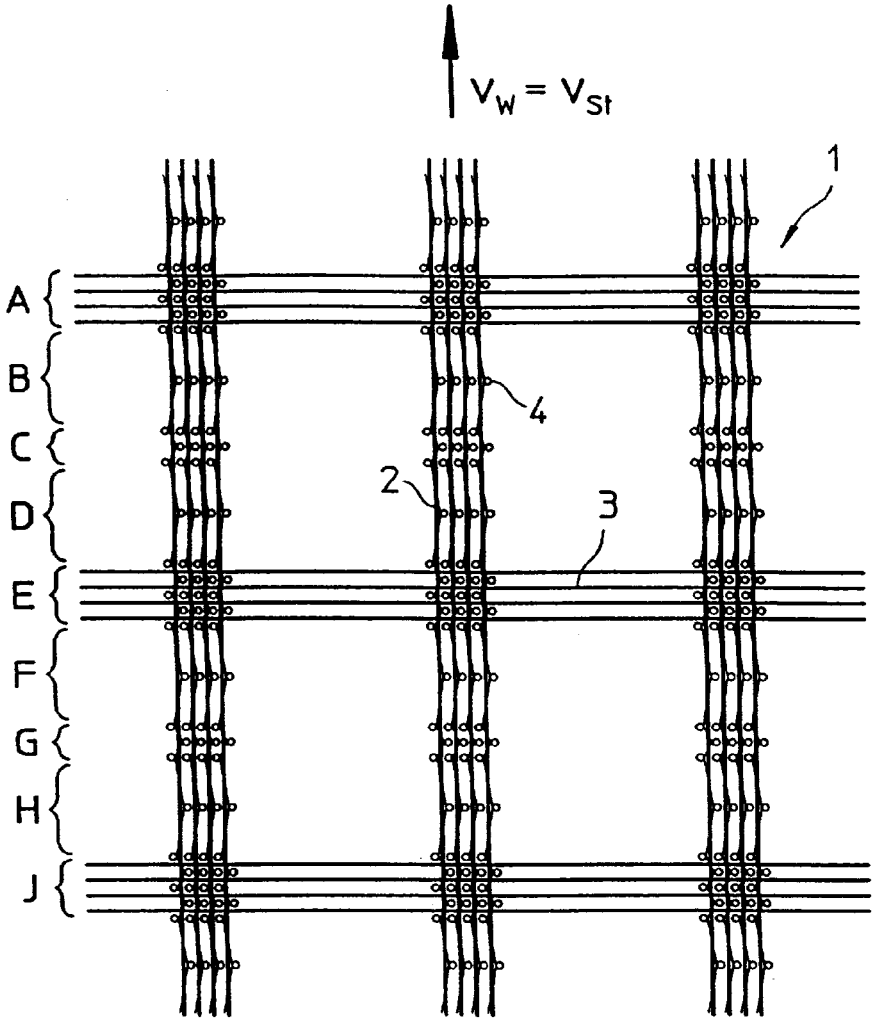
FIG. 3*a* is a simplified illustration of a knitted fabric having differing stitch densities within one repeat.
Figure 3B:
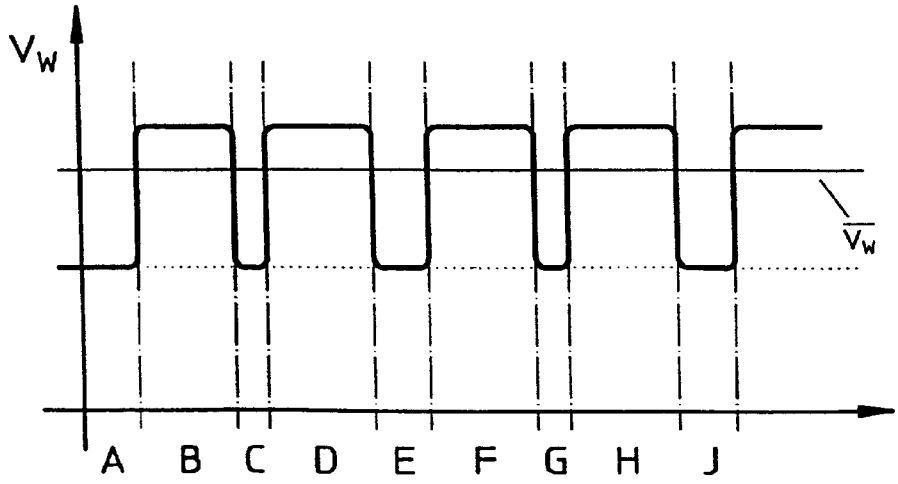
FIG. 3*b* is an illustration of the speed of the fabric pull-off of the fabric section during the production of the knitted fabric of 3*a;*

The description pertaining to FIGS. 2*a* and 2*b* is also valid for FIGS. 3*a* and 3*b* but with the difference that in this instance several differing stitch densities within a repeat are shown. In the spacing between the crossings of stay threads 2 and the weft threads 3, the stitch density is initially rather loose (area B and F). This is followed by an area of a tight stitch density (area C and G) which again is followed by an area of a loose stitch density (D and H) before the next crossing area. This example illustrates the multiple of possible variations in the knitted fabric according to the invention which can be matched with regard to quality and the scope of specific applications by using simple expedients.

Figure 4A:
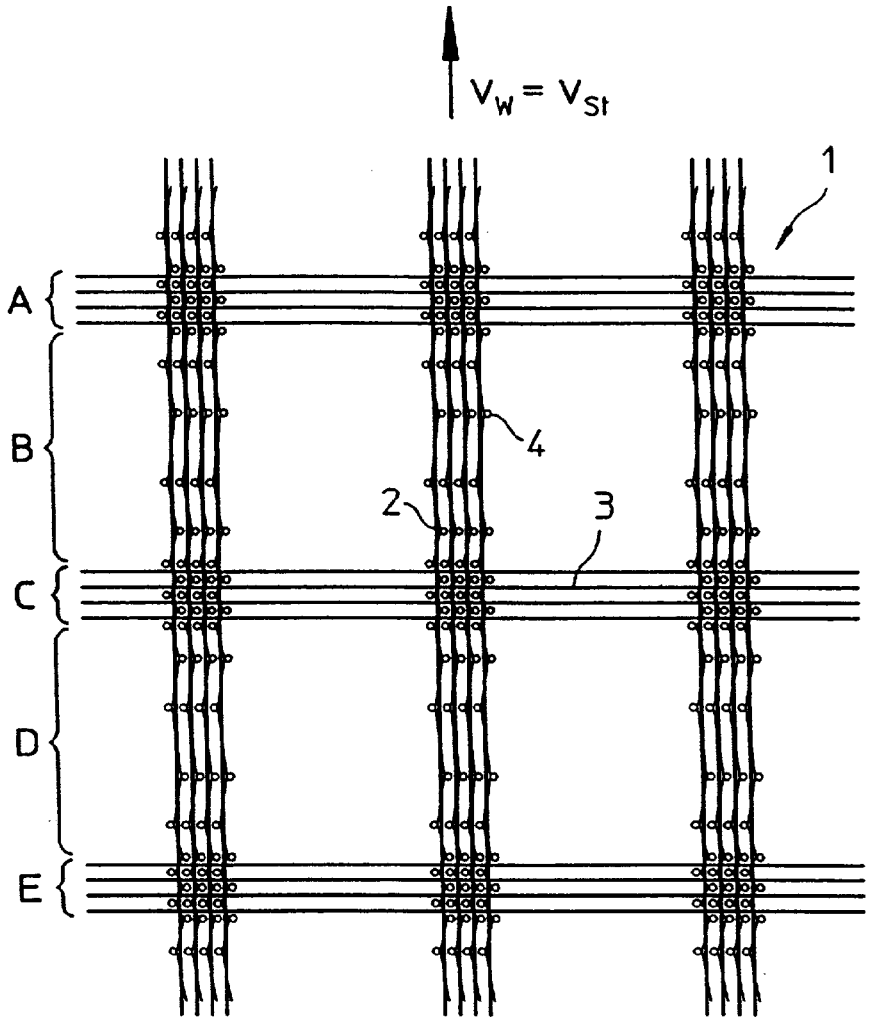
FIG. 4*a* is a simplified illustration of a knitted fabric having a continuously changing stitch density within one repeat.
Figure 4B:
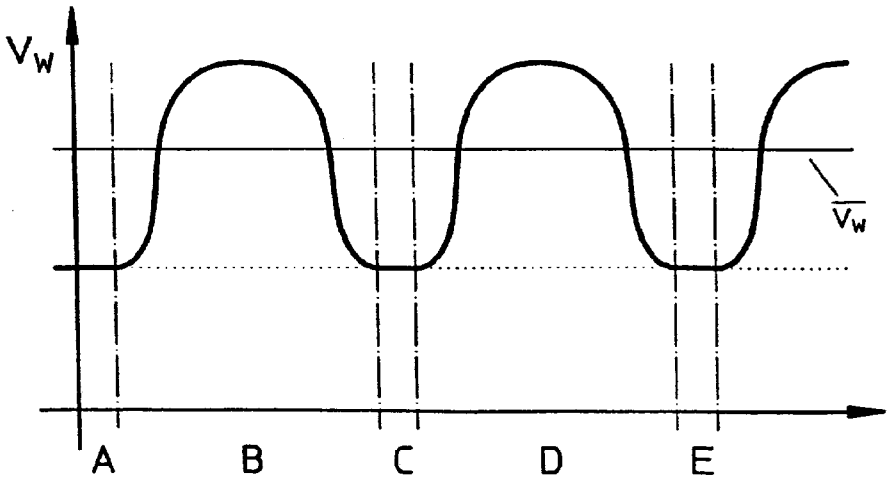
FIG. 4*b* illustrates the fabric pull-off speed of the fabric during the production of the knitted fabric of FIG. 4*a;*

FIGS. 4*a* and 4*b* illustrate an example of a further development of the Geo-grid of the invention in which the stitch density is continuously being changed by a corresponding continuous change in the speed of the fabric pull-off Vw.

Figure 5:
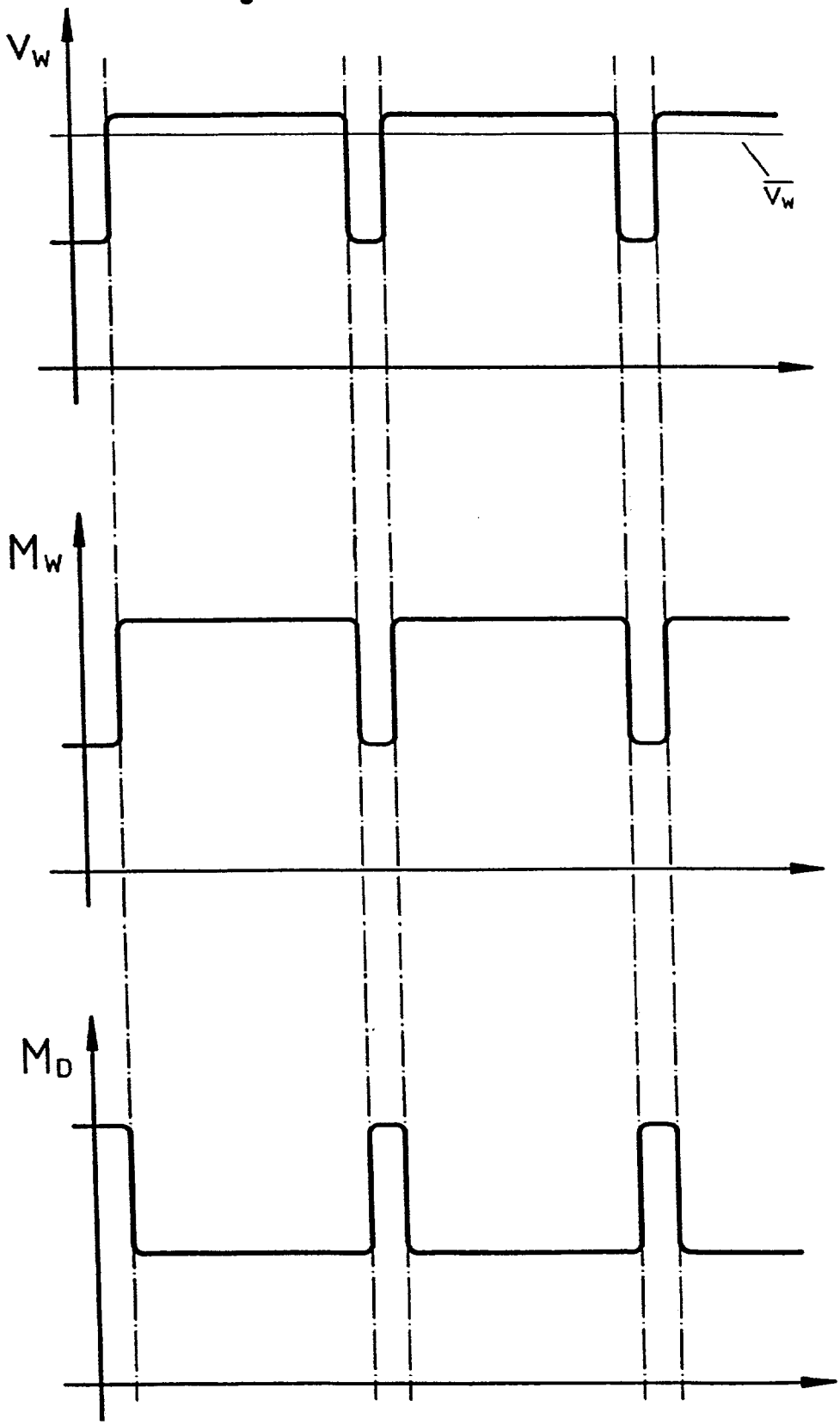
FIG. 5 illustrates the relationship between the speed of the fabric pull-off, the machine with and the stitch density over a fabric section.

FIG. 5 illustrates the relationship between the speed of the fabric pull-off Vw (when compared to a constant of the state of the art), the spacing between the stitches Mw and the stitch density Md in the method of producing a knitted fabric according to the invention. The stitch density, that is, the number of stitches per unit length in any one crossing area of the stay- and the weft threads is tight or high and it is loose or low between the crossing areas. The reverse is true for the stitch intensity Mw. The change in the stitch density is not caused by a change in the RPM of the machine but solely by a change in the pull-off speed Vw of the fabric.

Figure 6:
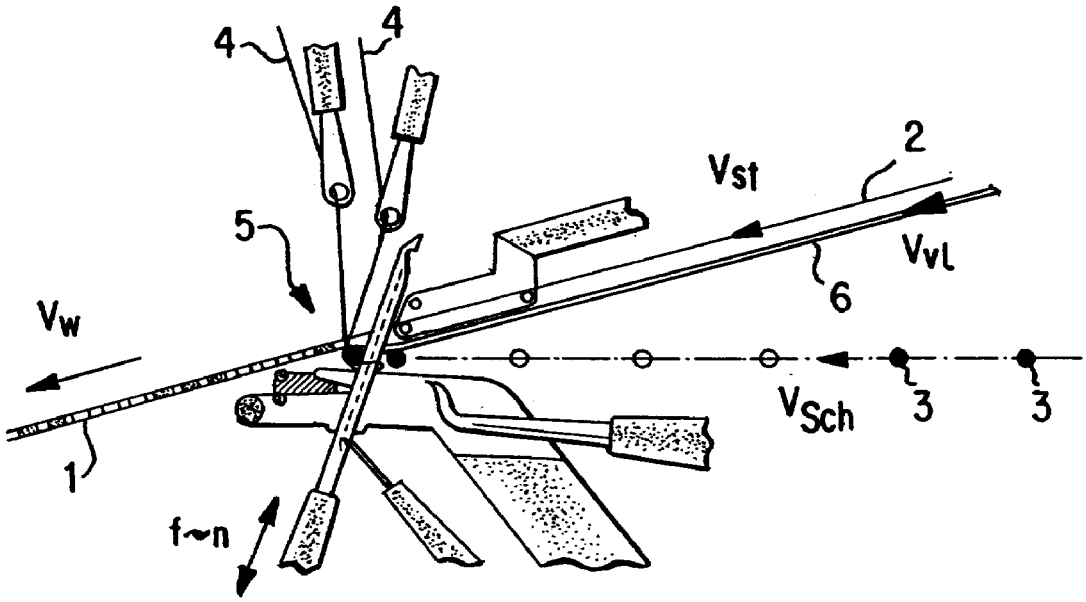
FIG. 6 is a schematic illustration of differing speeds and steps of the method for the production of a warped knitted fabric having large openings according to the invention.
Figure 7:
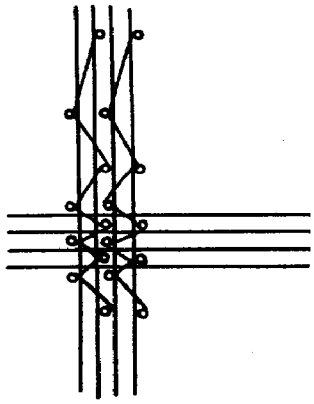
FIG. 7 is a simplified illustration of a second embodiment of knitted fabric wherein adjacent stay threads are connected to each other.

In order to elucidate the method of the invention, FIG. 6 schematically illustrates the differing speeds and procedures. In the knitting area 5 of a knitting machine (not shown), the stay threads 2 are connected to the obliquely inserted weft threads 3 and the warp thread 4 by the process of knitting. The stitches formed by the warp threads 4 are varied with regard to their density in the finished knitted fabric by varying the pull-off speed Vw of the fabric. The mean speed of the speed of the fabric pull-off is designated as Vw whereby the frequency of the stitch formation f and thereby the RPM of the knitting machine remain constant, that is, there is no interference with the complicated stitch formation process. The delivery speed Vst of the stay threads merely changes with a corresponding change in the speed Vw of the fabric pull-off. Also the delivery speed of the warp threads is matched with the overall usage. According to the development example in FIG. 6, a fleece 6 additionally runs into the knitting area having a speed Vvl which is essentially equal to the delivery speed of the stay threads.

What is claimed is:

1. Warp knitted fabric having stay and weft threads which are arranged biaxially, said stay threads cross the weft threads and are bound in by stitches formed by warp threads and further are knitted together with the weft threads in spaced apart crossing areas of said stay and weft threads, the number of stitches of said warp threads per unit length of said stay threads within a repeat and in a spacing between said crossing areas of the stay and weft threads being lower than within said crossing areas.

2. The warp knitted fabric of claim 1, wherein each of said stay threads is bound in with the weft threads by stitches formed by warp threads individually.

3. The warp knitted fabric of claim 1, wherein at least two adjacent stay threads are connected to each other.

4. A method for the production of a biaxial structure, said method including the steps of arranging stay and weft threads in a crosswise manner in spaced apart crossing areas which thereafter are knitted together by stitches formed by warp threads, reducing the number of said stitches in a repeat of said structure and in spacings between the crossing areas of said stay and weft threads as compared to the area within said crossing areas, pulling off said structure according to its repeat within the crossing areas at a slower rate than within the spacings between said crossing areas.

5. The method of claim 4 including the step of guiding-in a cover layer, such as a fleece, below said weft threads with a speed which is essentially the same as the delivery speed of said stay threads.

6. The method of claim 4 including the step of guiding-in a cover layer, such as a fleece between said stay threads and said weft threads with a speed which is essentially the same as the delivery speed of said stay threads.

7. The method of claim 6 including the step of varying the density of said stitches by maintaining the rotation speed of the machine.

8. The method as in any one of claims 4–7 including the steps of introducing weft threads by a weft insertion system and guiding the same by of lateral conveyors into an area of knitting needles and driving said lateral conveyors with a speed which is independent from the warp knitting machine producing said fabric and controlling said speed so that it is at least partially intermittent and/or continuous with at least a partially varying speed and therefore guiding said weft threads into the area of said knitting needles at arbitrary times and after each other in arbitrarily desired numbers.

9. The warp knitted fabric of claim 1, which further comprises large grid openings.

10. The method of claim 4, wherein the structure is a warp knitted fabric having large grid openings.

* * * * *